US007062874B1

(12) United States Patent
Smith

(10) Patent No.: US 7,062,874 B1
(45) Date of Patent: Jun. 20, 2006

(54) METHOD AND APPARATUS FOR INSTALLING A FIXTURE TO THE MUZZLE END OF A FIREARM

(75) Inventor: Brooke C. Smith, Aliso Viejo, CA (US)

(73) Assignee: Surefire, LLC, Fountain Valley, CA (US)

( * ) Notice: Subject to any disclaimer, the term of this patent is extended or adjusted under 35 U.S.C. 154(b) by 20 days.

(21) Appl. No.: 11/015,685

(22) Filed: Dec. 16, 2004

(51) Int. Cl.
*F41A 21/00* (2006.01)

(52) U.S. Cl. ..... 42/1.01; 42/90; 42/106; 89/14.3; 89/14.4; 89/1.1

(58) Field of Classification Search ..... 42/1.01, 42/90, 107, 106; 89/14.2, 14.3, 14.4, 1.1
See application file for complete search history.

(56) References Cited

U.S. PATENT DOCUMENTS

| | | | | |
|---|---|---|---|---|
| 2,953,972 | A | 9/1960 | Sorensen | |
| 4,510,843 | A | 4/1985 | Rabatin | |
| 4,570,529 | A | 2/1986 | A'Costa | |
| 5,005,463 | A | 4/1991 | A'Costa | |
| 5,092,223 | A | 3/1992 | Hudson | |
| 5,110,151 | A | 5/1992 | Blechschmidt et al. | |
| 5,433,133 | A | 7/1995 | La France | |
| RE35,381 | E | 11/1996 | Rose | |
| 5,596,161 | A | 1/1997 | Sommers | |
| 5,698,810 | A | 12/1997 | Rose | |
| 5,773,746 | A | 6/1998 | Vaden | |
| RE36,058 | E | 1/1999 | Sokol | |
| 5,860,242 | A | 1/1999 | O'Neil | |
| 5,883,328 | A | 3/1999 | A'Costa | |
| 5,960,576 | A * | 10/1999 | Robinson | 42/90 |
| 6,065,384 | A | 5/2000 | Widder et al. | |
| 6,216,578 | B1 | 4/2001 | Ledys et al. | |
| 6,276,251 | B1 | 8/2001 | Downing et al. | |
| 6,298,764 | B1 | 10/2001 | Sherman et al. | |
| 6,308,609 | B1 | 10/2001 | Davies | |
| 6,450,079 | B1 | 9/2002 | Bourdin et al. | |
| 6,619,179 | B1 * | 9/2003 | Mika | 89/14.05 |
| 6,837,139 | B1 | 1/2005 | Meyers | |
| 2004/0079221 | A1 * | 4/2004 | Woods et al. | 89/14.4 |

OTHER PUBLICATIONS

Operator's/Armorer's Manual, Surefire Model-FA M4 Carbine High Endurance Fast-Attach Sound Suppressor Kit, Mar. 2003, SureFire Suppressors Division, Fountain Valley, CA.

* cited by examiner

*Primary Examiner*—J. Woodrow Eldred
(74) *Attorney, Agent, or Firm*—David Weiss

(57) ABSTRACT

A method and apparatus for installing a fixture, such as a flash suppressor, to the threaded muzzle end of a firearm barrel. A chart or "timing wheel" is directly placed to the fixture when hand tightened to the firearm's muzzle end without any shims placed thereon, the chart identifying the appropriate shims to be placed on the barrel's threaded muzzle end portion for positioning the center of the flash suppressor vent substantially at top dead center with respect to the barrel when a predetermined torque is applied to the flash suppressor.

69 Claims, 3 Drawing Sheets

METHOD AND APPARATUS FOR INSTALLING A FIXTURE TO THE MUZZLE END OF A FIREARM

BACKGROUND OF THE INVENTION

This invention relates to firearms, and more particularly to methods and apparatus for installing a fixture such as a flash suppressor to the threaded muzzle end of a firearm barrel.

The suppression of muzzle flash and the reduction of muzzle lift upon the firing of a bullet from a firearm are conventionally implemented by a vented fixture fixedly secured to the firearm's muzzle end. In a commonly utilized type of fixture, functioning as a flash suppressor as well as a muzzle brake or compensator, the vent is provided by an odd plurality of longitudinal slots through the wall of the generally tubular fixture or flash suppressor. It is well known that the flash suppressor should be affixed to the firearm's muzzle such that the middle slot (i.e., the rotational center of the vent) is at top dead center (i.e., at the 12 o'clock position) with respect to the longitudinal axis of the firearm barrel.

In one manner of installing a fixture such as a flash suppressor to the threaded muzzle end portion of a firearm barrel, one or more shims are placed about the barrel's threaded muzzle end portion and between the barrel's forwardly facing annular shoulder situated rearwardly of the barrel's threaded muzzle end portion and a rearwardly facing shoulder of the flash suppressor situated rearwardly of a threaded bore of the flash suppressor. The flash suppressor is fixedly secured to the barrel when the correct shims are in place and a predetermined torque is applied to the flash suppressor with respect to the barrel, resulting in the flash suppressor's middle slot being fixedly positioned at top dead center.

Before the present invention, the appropriate shims were selected by a trial and error repetition of steps. The installer would thread the flash suppressor onto the barrel's threaded muzzle end portion hand tight, whereupon the installer would note the rotational location of the middle slot. If the middle slot is not at top dead center when the predetermined torque is applied to the flash suppressor with respect to the barrel, the flash suppressor is unthreaded and removed from the barrel. One or more shims are selected and placed onto the barrel's threaded muzzle end portion, whereupon the flash suppressor is again threaded onto the barrel's threaded muzzle end portion and the predetermined torque is applied to the flash suppressor with respect to the barrel, and the rotational position of the middle slot is again noted. If the middle slot is not at top dead center, the flash suppressor is again unthreaded and removed from the barrel, shims are added to or subtracted from the barrel's threaded end portion, the flash suppressor is again threaded onto the muzzle end portion and the predetermined torque is again applied and the rotational location of the middle slot is again noted. These steps are repeated until the middle slot is at top dead center.

SUMMARY OF THE INVENTION

The method and apparatus for installing a fixture or flash suppressor to a firearm barrel in accordance with the present invention eliminates the trial and error series of shim placements and flash suppressor placement/torquing/removal steps of the prior art methods. The method of the present invention greatly facilitates the selection of the appropriate shims by providing a chart or "timing wheel" that is directly placed to the flash suppressor when hand tightened to the firearm barrel's threaded muzzle without any shims placed thereon. The chart identifies the appropriate shims to be placed on the barrel's threaded muzzle end portion for positioning the center of the flash suppressor's vent (i.e., the middle slot) substantially at top dead center with respect to the barrel when the predetermined torque is applied to the flash suppressor.

In accordance with one aspect of the present invention, there is provided a preferred embodiment of a method for installing a fixture to a threaded muzzle end portion of a barrel of a firearm having a sight rearwardly of the threaded muzzle end portion, the barrel having a forwardly facing annular shoulder rearwardly of the threaded muzzle end portion, the method comprising the steps of: providing a fixture including a generally cylindrical wall, an axial passageway having a threaded bore, a rearwardly facing annular shoulder rearwardly of the threaded bore, and a vent through the wall communicating with the passageway; providing a plurality of annular shims of predetermined thicknesses; providing a chart having an aperture for axially receiving the fixture, the chart including a sight alignment mark vertically above the center of the aperture, the chart including sectors about the aperture including indicia identifying shims for being interposed between the shoulders when the fixture is threaded onto the threaded muzzle end portion and a predetermined torque is applied thereto for rotationally positioning the fixture with the center of the vent substantially at top dead center, one of the sectors corresponding to no shims required being displaced from a chart location at a predetermined rotational angle (preferably 180°) from the sight alignment mark by a rotational displacement representing application of the predetermined torque; threading the fixture onto the threaded muzzle end portion of the barrel until the shoulder of the fixture is in contact engagement with the shoulder of the barrel; placing the chart to the fixture such that the fixture axially extends through the aperture and with the sight alignment mark rotationally aligned with the sight of the firearm; noting the identifying indicia in the sector to which a location on the wall is rotationally aligned, such location on the wall being at the aforementioned predetermined rotational angle (preferably 180°) from the center of the vent; removing the chart from the fixture; unthreading the fixture from the threaded muzzle end portion; selecting shims from the plurality of shims, the selected shims determined by the noted identifying indicia; placing the selected shims about the threaded muzzle end portion; and fixedly securing the fixture to the barrel when the fixture is threaded onto the threaded muzzle end portion with the selected shims interposed between the shoulder of the fixture and the shoulder of the barrel and with the predetermined torque applied to the fixture. In the indicia-noting step, the location on the fixture wall may be designated by a mark on the wall, which mark may comprise a notch at the front edge of the wall.

A second preferred embodiment of the method for installing a fixture to a threaded muzzle end portion of a barrel of a firearm having a sight rearwardly of the threaded muzzle end portion, the barrel having a forwardly facing annular shoulder rearwardly of the threaded muzzle end portion, comprises the steps of: providing a fixture including a generally cylindrical wall, an axial passageway having a threaded bore, a rearwardly facing annular shoulder rearwardly of the threaded bore, and a vent through the wall communicating with the passageway; providing a plurality of annular shims of predetermined thicknesses; providing a chart having an aperture for axially receiving the fixture, the chart including a sight alignment mark vertically above the center of the aperture, the chart including sectors about the aperture including indicia identifying shims for being interposed between the shoulders when the fixture is threaded onto the threaded muzzle end portion and a predetermined torque is applied thereto for rotationally positioning the fixture with the center of the vent substantially at top dead center, one of the sectors corresponding to no shims required being displaced from the sight alignment mark by a rotational displacement representing application of the predetermined torque; threading the fixture onto the threaded muzzle end portion of the barrel until the shoulder of the fixture is in contact engagement with the shoulder of the barrel; placing the chart to the fixture such that the fixture axially extends through the aperture and with the sight alignment mark rotationally aligned with the sight of the firearm; noting the identifying indicia on the sector to which the center of the vent is rotationally aligned; removing the chart from the fixture; unthreading the fixture from the threaded muzzle end portion; selecting shims from the plurality of shims, the selected shims determined by the noted identifying indicia; placing the selected shims about the threaded muzzle end portion; and fixedly securing the fixture to the barrel when the fixture is threaded onto the threaded muzzle end portion with the selected shims interposed between the shoulder of the fixture and the shoulder of the barrel and with the predetermined torque applied to the fixture.

According to another aspect of the present invention, there is provided a preferred embodiment of a chart for facilitating installation of a fixture to a threaded muzzle end portion of a barrel of a firearm having a sight rearwardly of the threaded muzzle end portion, the fixture including an axial passageway having a threaded bore, a rearwardly facing annular shoulder rearwardly of the threaded bore, and a vent communicating with the passageway, the barrel of the firearm including a forwardly facing annular shoulder rearwardly of the threaded muzzle end portion, the preferred chart embodiment comprising: a substrate having a central aperture for axially receiving the fixture; a sight alignment mark on the substrate vertically above the center the aperture; and printed sectors about the aperture including indicia identifying shims for being interposed between the shoulder of the fixture and the shoulder of the barrel when the fixture is threaded onto the threaded muzzle end portion and a predetermined torque is applied to the fixture for rotationally positioning the fixture with the center of the vent substantially at top dead center, one of the sectors corresponding to no shims required being displaced from a chart location at a predetermined rotational angle (preferably substantially 180°) from the sight alignment mark by a rotational displacement representing application of the predetermined torque.

In a second preferred embodiment of the chart according to the present invention, the printed sector corresponding to no shims required is displaced from the sight alignment mark, by a rotational displacement representing application of the predetermined torque.

In either chart embodiment, the indicia respectively included in the printed sectors identify the shims by one or more indicia selected from the group consisting of calculated aggregate thicknesses, thicknesses of specific ones of the provided shims, and color code associated with specific ones of the provided shims.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Turning first to FIGS. 1–4, 6 and 8, there is illustrated (in FIG. 1) an example of a firearm 20, such as an M4 or M16 automatic rifle, including a barrel 22 having a longitudinal axis a along which a fired bullet is caused to travel upon firing of the firearm 20, and a front sight 26 secured to the barrel 22 and situated above the longitudinal axis a. A generally tubular fixture 24 having longitudinal axis a' (FIG. 2) is fixedly secured to the firearm's muzzle with the fixture's longitudinal axis a' coinciding with the firearm barrel's longitudinal axis a. The fixture 24 is preferably a flash suppressor which also functions as a muzzle brake or compensator, and which when properly installed to the muzzle of the firearm barrel 22 (as in FIG. 1) serves to suppress muzzle flash as well as to reduce muzzle lift on firing.

Figure 1:
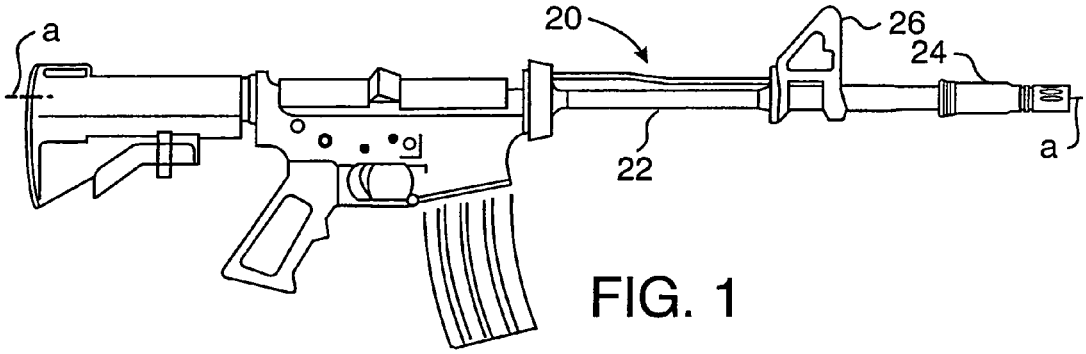
FIG. 1 is a side view of a firearm equipped with a flash suppressor properly installed at the muzzle end of the firearm's barrel.
Figure 2:
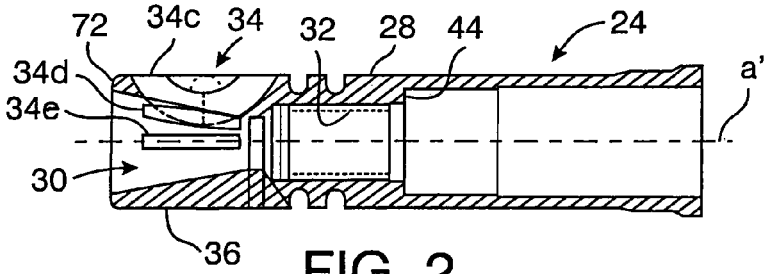
FIG. 2 is a side cross-sectional view of a flash suppressor as in FIG. 1.
Figure 4:
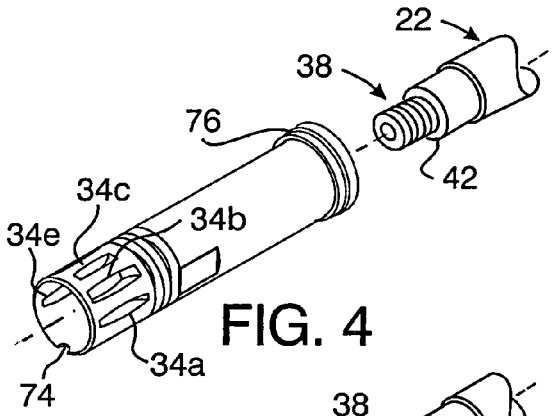
FIG. 4 is an exploded perspective view of the flash suppressor of FIG. 2 being placed to the muzzle end of the firearm barrel of FIG. 1.
Figure 6:
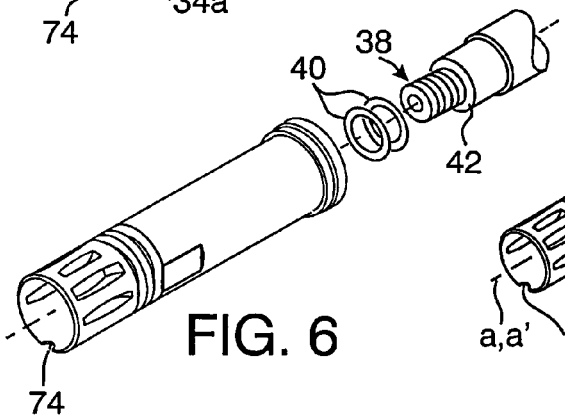
FIG. 6 is a perspective view as in FIG. 4 but shown with selected ones of the annular shims of FIG. 5 being placed during installation of the flash suppressor to the muzzle end portion of the firearm barrel.
Figure 8:
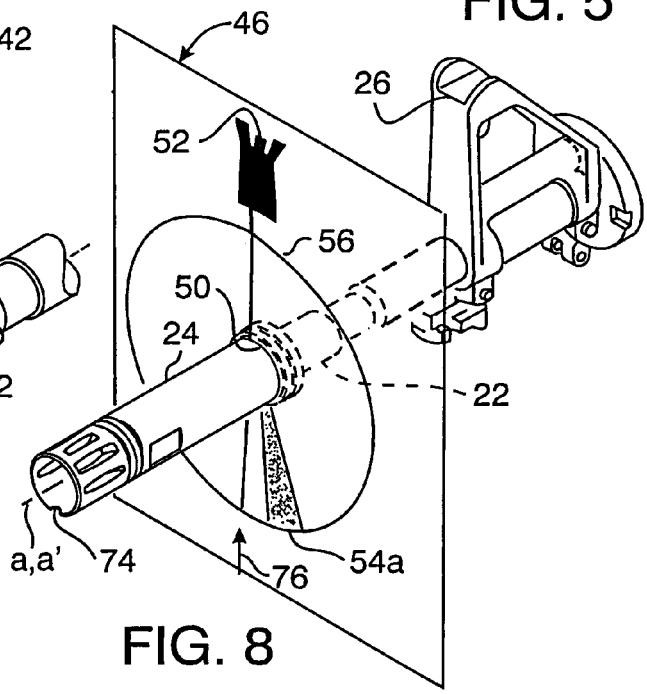
FIG. 8 is a front perspective view of the chart of FIG. 7 shown being used during installation of the flash suppressor to the muzzle end portion of the firearm barrel in accordance with the method of the present invention.

As used herein, the word "front" or "forward" corresponds to the firing direction of the firearm 20 (i.e., to the right as shown in FIG. 1, and to the left as shown in FIG. 2 and generally in FIGS. 4, 6 and 8); "rear" or "rearward" corresponds to the direction opposite the firing direction of the firearm 20 (i.e., to the left as shown in FIG. 1, and to the right as shown in FIG. 2 and generally in FIGS. 4, 6 and 8); and "longitudinal" means the direction along or parallel to the longitudinal axis a of the barrel 22 of the firearm 20, or to the longitudinal axis a' of the flash suppressor 24.

The examples of the fixture or flash suppressor 24 shown in FIGS. 1–4 are of a type to which a noise suppressor may be removably secured as taught in U.S. patent application Ser. No. 10/703,971 of John W. Matthews and Brooke C. Smith, assigned to the assignee of the present application. Application Ser. No. 10/703,971 is incorporated in full herein by reference.

The flash suppressor of FIGS. 1–4 includes a generally cylindrical wall 28, an axial passageway 30 having a threaded bore 32, and a vent 34 through the wall 28 forwardly of the threaded bore 32 and communicating with the passageway 30. The vent 34 is symmetrically distributed through the forward portion 36 of the wall 28, and the vent's rotational center is preferably rotationally aligned with the firearm's sight 26 during installation of the flash suppressor 24 onto the firearm barrel 22, i.e. the vent's rotational center is preferably positioned at 12 o'clock or at top dead center.

In the preferred embodiment of the flash suppressor 24, the vent 34 comprises at least one slot, and preferably an odd plurality of slots, longitudinally extending along and circumferentially evenly spaced about a sector of the front end portion 36 of the flash suppressor 24. In the example of the flash suppressor 24 shown in FIGS. 1–4, the longitudinally extending slots are five in quantity (referred to individually as slots 34*a*, 34*b*, 34*c*, 34*d* and 34*e*, and referred to collectively as the vent 34 or slots 34), and are rotationally spaced about an approximately 180° sector of the front end portion 36. Proper installation of the flash suppressor 24 to the muzzle end of the firearm barrel would require that the middle slot 34*c* (i.e., the third slot in this five slot vent 34) be at the 12:00 o'clock or top dead center position when the flash suppressor 24 is longitudinally tightened to and fixedly secured to the barrel 22.

Figure 5:
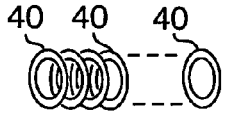
FIG. 5 is a perspective view of a plurality of annular shims for use during installation of the flash suppressor on the muzzle end portion of the firearm barrel.

In one manner of installing a fixture such as the flash suppressor 24 to the threaded muzzle end portion 38 of the firearm barrel 22, one or more shims 40 selected from a plurality of annular shims 40 of various thicknesses and preferably of stainless steel (as represented in FIG. 5) are placed about the barrel's threaded muzzle end portion 38 and between the barrel's forwardly facing annular shoulder 42 situated rearwardly of the barrel's threaded muzzle end portion 38 (see FIG. 6) and a rearwardly facing shoulder 44 of the flash suppressor 24 situated rearwardly of the flash suppressor's threaded bore 32.

Rotating the flash suppressor 24 for its being threaded or unthreaded on the barrel's threaded muzzle end portion 38 causes axial translation of the flash suppressor 24 along the barrel's longitudinal axis a (the longitudinal axes a and a' being coincident) by a longitudinal distance determined by the pitch of the threads of the threaded muzzle 38. The aggregate thickness of the selected shims 40, when interposed between the shoulders 42 and 44 and compressed therebetween by the application of a predetermined torque to the flash suppressor 24 with respect to the barrel 22, should be such that the rotational center of the vent 34 (i.e. the middle or third slot 34*c*) in the flash suppressor's front end portion 36 is at top dead center of the firearm barrel 22 (i.e., rotationally aligned with the firearm's sight 26, or at the barrel's 12:00 o'clock position). The flash suppressor 24 is fixedly secured to the barrel 22 while the selected shims 40 are in place and the predetermined torque is applied, resulting in the middle slot 34*c* being fixedly positioned at top dead center.

Before the present invention, the appropriate shims were selected by a trial and error repetition of steps. The installer would thread the flash suppressor 24 onto the barrel's threaded muzzle end portion 38 hand-tight, i.e. until the flash suppressor shoulder 44 firmly contacts the barrel shoulder 42 (see FIGS. 2 and 4), whereupon the installer would note the location of the center of the vent 34 or the middle slot 34*c*. If the middle slot 34*c* is not at top dead center when the predetermined torque is applied to the flash suppressor 24 (which predetermined torque typically comprises a range of 20 to 30 foot-pounds), the flash suppressor 24 is unthreaded and removed from the barrel 24. One or more shims 40 are selected from the plurality of shims 40 (FIG. 5) and placed onto the barrel's threaded muzzle end portion 38, whereupon the flash suppressor 24 is threaded onto the barrel's threaded end portion 38 (see FIG. 6) and the predetermined torque (the torque range of 20–30 foot-pounds) is applied to the flash suppressor 24 with respect to the barrel 22, and the rotational position of the middle slot 34*c* is again noted. If the middle slot 34*c* is not at top dead center, the flash suppressor 24 is again unthreaded and removed from the barrel 22, shims are added to or subtracted from the barrel's threaded end portion 38, the flash suppressor 24 is again threaded onto the muzzle end portion 38 and the predetermined torque is again applied and the rotational location of the middle slot 34*c* is again noted. These steps are repeated until the middle slot 34*c* is at top dead center when the predetermined torque (range between 20–30 foot-pounds) is applied to the flash suppressor 24.

The pitch of the threads of the threaded muzzle end portion 38 of M4 and M16 firearms, as well as other firearms included in the M16 family, corresponds to twenty-eight threads per inch along the barrel's longitudinal axis a, so that one revolution of the flash suppressor 24 on the barrel's threaded end portion 38 results in axial translation of the flash suppressor 24 by a distance of approximately 0.0357 inch. The installer is typically provided with shim information correlating shim thicknesses with approximate flash suppressor rotations, for assisting the installer in selecting shims for tentative installation in this prior art trial and error method. For example, one such information item may specify that a shim having a thickness of 0.010 inch represents flash suppressor translation corresponding to rotation of the flash suppressor by approximately one-quarter revolution.

The method of the present invention is an improvement over the method just described, greatly facilitating the selection of the appropriate shims 40 and eliminating the trial and error series of shim placements and flash suppressor placement/torquing/removal steps. The method of the present invention provides a chart or "timing wheel" that is directly placed to the flash suppressor 24 when hand-tightened to the firearm barrel's threaded muzzle end portion 38 without any shims 40 placed thereon. The chart identifies the appropriate shims to be placed on the barrel's threaded muzzle end portion 38 for positioning the center of the flash suppressor's vent 34 (i.e. the middle slot 34*c*) substantially at top dead center with respect to the barrel 22 when the predetermined torque is applied to the flash suppresser 24.

Figure 7:
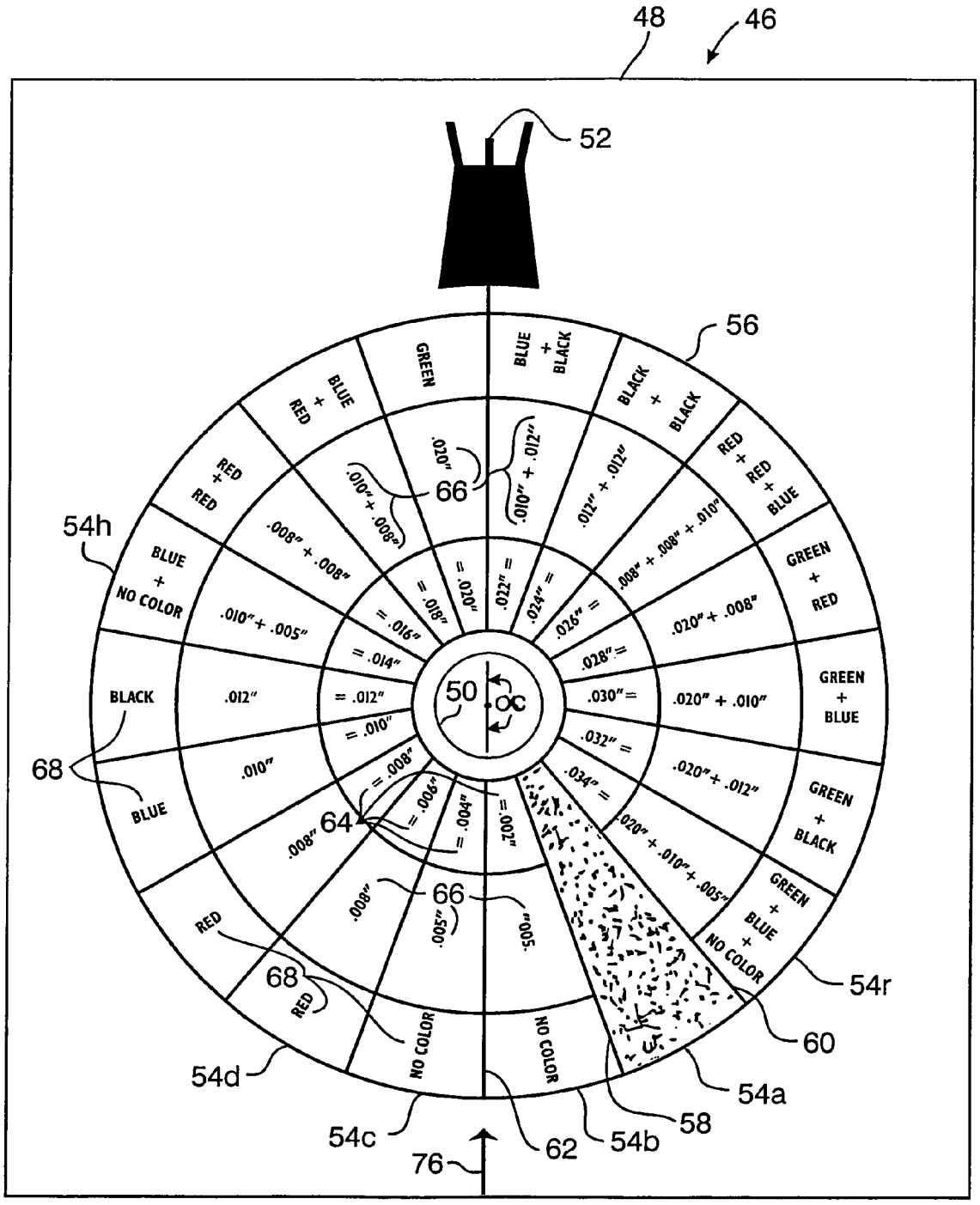
FIG. 7 is a front view of a preferred embodiment of a chart according to the present invention for facilitating installation of the flash suppressor to the muzzle end portion of the firearm barrel in accordance with the method of the present invention.

A preferred embodiment of the chart 46 is shown in FIG. 7, and comprises a substrate 48 such as a sheet of any suitable material (for example paper, cardboard, plastic, metal, wood) having a circular aperture 50 of a diameter for receiving or encircling the flash suppressor 22 such that the center of the aperture 50 coincides with the suppressor's longitudinal axis a' when the chart 46 is situated in a plane orthogonal to the axis a'.

The chart 46 is intended to be positioned in a vertical plane orthogonal to the coinciding longitudinal axes a and a' when the firearm 20 is supported such that its barrel's longitudinal axis a is horizontally disposed and the firearm sight 26 projects vertically above the axis a. In consideration of such reference, the chart includes a sight alignment mark 52 on the substrate 48, which sight alignment mark 52 may be represented by a sight icon 52 depicted in FIG. 7, vertically above the center of the aperture 50.

Printed sectors 54 of a printed circle 56 concentric with the aperture 50, radiate from the center of and about the aperture 50, the sectors including indicia thereon identifying shims required to be interposed between the shoulder 44 of the flash suppressor and the shoulder 42 of the barrel 22 when the flash suppressor 24 is threaded onto the barrel's threaded muzzle end portion 38 and the predetermined torque is applied to the flash suppressor 24 for rotationally situating the flash suppressor 24 with the center of the vent 34 (the middle slot 34*c*) substantially at top dead center.

In the preferred chart embodiment 46 shown in FIG. 7, there are eighteen sectors 54 designated with the reference numerals 54*a*, 54*b*, 54*c*, . . . 54*r*. The shaded first or reference sector 54*a* is rotationally displaced from a chart location at a predetermined rotational angle α, preferably 180°, from the sight alignment mark 52 by a rotational displacement representing application of the predetermined torque. The radial boundaries 58 and 60 of the sector 54*a* are rotationally counterclockwise displaced from the 6 o'clock position of the vertical diameter or radius 62 of the circle 56, corresponding to rotation of the flash suppressor 24 attributable to application of the predetermined torque. For example, for a predetermined torque having a range of 20 to 30 foot-pounds, the sector 54*a* radius 58 (i.e., the radial boundary of the sector 54*a* closer to the 6 o'clock position) is rotationally displaced from the vertical radius 62 by an angle substantially equal to the angular rotation of the flash suppressor 24 attributable to the application thereto of a 20 foot-pound torque, while the rotational displacement of the sector 54*a* radius 60 from the 6 o'clock position is substantially equal to the angular rotation of the flash suppressor 24 attributable to the application thereto of a 30 foot-pound torque. In preparing the preferred chart embodiment 46 of FIG. 7, the rotational position and included angle of the sector 54*a* were empirically determined.

When the flash suppressor 24 is threaded hand-tight onto the firearm barrel threaded muzzle end portion 38 without the interposition of any shims 40, and the chart is placed onto the flash suppressor 24 with the sight alignment mark 52 rotationally aligned with the firearm sight 26, a "point" or location on the flash suppressor 24 at the predetermined rotational angle α, preferably 180°, from the center of the flash suppressor's vent 34 (i.e., 180° from the middle slot 34*c*) which fortuitously happens to be rotationally aligned within the sector 54*a* would indicate that no shims 40 would be required to place this point along the chart's vertical radius 62 (i.e., at the 6 o'clock position) when the flash suppressor 24 is torqued to the predetermined torque (i.e. the range from 20 to 30 foot-pounds), thereby placing the middle slot 34*c* at top dead center. Accordingly, if that same point on the flash suppressor 24 were not at the sector 54*a* when the flash suppressor 24 is hand tightened to the barrel threaded muzzle end 38, the rotational angle by which the flash suppressor 24 must be unthreaded to place that point at the reference sector 54*a* will determine the axial distance between the barrel and suppressor shoulders 42 and 44. When the appropriate shims 40 are identified and interposed between the shoulders 42 and 44, the application of the predetermined torque will place that point at the 6 o'clock position and consequently the middle slot 34*a* will be placed at the 12 o'clock position or top dead center.

The chart 46 has printed thereon indicia displaying information concerning the shims 40 to be interposed between the shoulders 42 and 44 for placing the middle slot 34*c* at top dead center when the predetermined torque is applied to the flash suppressor 24. In the preferred chart embodiment shown in FIG. 7, a set of first indicia 64 displays calculated distances between the barrel and flash suppressor shoulders 42 and 44 as a function of flash suppressor rotation, the set of such indicia being referenced from the sector 54*a*. The first indicia 64 are mathematically calculated from a knowledge of the thread pitch of the barrel threaded muzzle end 38. The preferred chart 46 is designed for use with a firearm of the M16 family, where the pitch of the muzzle threads correspond to twenty-eight threads per inch so that one complete revolution of the flash suppressor 24 on the threaded muzzle corresponds to an axial displacement of the flash suppressor by 1/28 inch. Each of the seventeen equal sectors 54*b*, 54*c*, . . . 54 *r* shown in the preferred chart embodiment normally corresponds to a 20° rotation of the flash suppressor 24 in turn corresponding to axial translation of approximately 0.002 inch, and the set of first indicia 64 printed within the sectors 54*b* through 54*r* specify such axial translation or distance as a function of unthreading of the flash suppressor 24 in increments of 0.002 inch clockwise referenced from the sector 54*a*.

The chart 46 in FIG. 7 includes a set of second indicia 66 printed in the respective sectors 54 which identify the shims 40 to be interposed between the barrel and flash suppressor shoulders 42 and 44. The second indicia 66 identify the shims by their thicknesses, based upon the calculated indicia 64 respectively in the same sectors 54 and empirically derived adjustments thereto. It has been found that it is better not to use very thin shims, specifically shims of thickness less than 0.005 inch. In situations where the calculated first indicia 64 call for one or more shims less than 0.005 inch, it has been found advantageous to use shims of aggregate thickness greater than the calculated value and to compensate by applying a torque slightly greater than in the normally applied 20–30 foot-pound range. Examples of such adjustments in the second indicia 66 are shown in sectors 54*b, c, d, h* and *r* in the preferred chart embodiment 46 of FIG. 7.

A set of third indicia 68 in the respective sectors 54*b, c, . . . r* identify the shims designated by the second indicia 66 by color code; i.e., a different color (or no color) is applied to shims of respectively different thicknesses.

Of course, the segments 54 *b, c, . . . r* need not include all three indicia 64, 66 and 68, but may instead include any one or more of such indicia 64, 66 or 68.

The shims provided in the plurality of shims 40 of FIG. 5, or shim kit, correspond to the shims identified by the second indicia 66 in the preferred chart embodiment 46 of FIG. 7, such that the shims identified in any one of the sectors 54 may be implemented when the flash suppressor 24 is installed to the firearm barrel 22. An example of the minimum quantity of the various shims 40 in a preferred shim kit is shown in the following list:

| Quantity | Thickness | Color |
|---|---|---|
| 1 | 0.005 | no color |
| 2 | 0.008 | red |
| 1 | 0.010 | blue |

-continued

| Quantity | Thickness | Color |
|---|---|---|
| 2 | 0.012 | black |
| 1 | 0.020 | green |

Figure 3:
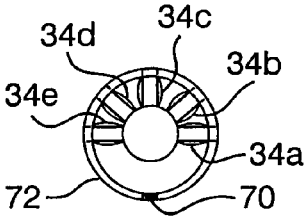
FIG. 3 is a front view of the front end portion of the flash suppressor of FIG. 2.

In practicing the installation method of the present invention, the "point" on the flash suppressor 24 located 180° from the center of the flash suppressor's vent 34, referred to in the above discussion, may be exemplified by a mark 70 applied to the flash suppressor's front end portion 36 of the wall 28, preferably along the annular front edge 72. The mark 70 may be applied to the flash suppressor 24 in any manner, for example by being printed or inscribed on the front edge 72 as indicated in FIG. 3. In a preferred example of the mark 70, the mark 70 is in the form of a forwardly facing notch 74 at the flash suppressor's front edge 72, as shown in FIG. 4, which notch 74 may be used for receiving a radially disposed indexing pin of a noise suppressor removably securable to the flash suppressor 24 as taught in the aforementioned U.S. patent application Ser. No. 10/703,971. In any event, the mark 70 or 74 is positioned on the flash suppressor front end portion 36, preferably at the front edge 72, substantially 180° displaced from the center of the flash suppressor vent 34 (or middle slot 34*c*).

In practicing the method of the present invention as represented in FIGS. 4–8, the installer preliminarily supports the firearm 20, for example by placing the firearm's upper receiver in an appropriate vise, preferably with the barrel axis a horizontally disposed, the firearm's front sight 26 vertically oriented above the axis a, and the firearm's threaded muzzle end portion 38 facing the installer. The installer thereupon threads the flash suppressor 24 onto the barrel's muzzle end portion 38, hand tight, with the flash suppressor shoulder 44 in firm contact engagement with the barrel shoulder 42.

The installer then slides the chart 46 onto the flash suppressor 24, with the flash suppressor 24 received by within the circular aperture 50. The flash suppressor 24 shown in the drawing includes a circumferential ridge 76 of diameter slightly greater than the chart aperture 50, which may be utilized for stopping further rearward movement of the chart 46 and for assisting the retaining of the chart 46 in a vertical plane orthogonal to the coincident longitudinal axes a, a'.

The installer thereupon adjusts the rotational position of the chart 46 about the axis a' such that the sight alignment mark 52 is rotationally aligned with the firearm's front sight 26, as shown in FIG. 8.

At this point, the installer notes the rotational position of the flash suppressor front end mark or notch 74 with respect to the sectors 54 on the chart 46. The installer notes any, one or more of the shim identifying indicia 64, 66, 68 within the particular sector 54 aligned with the notch 74. If the notch 74 is aligned with sector 54*a*, the installer notes that no shim will be required. If, for example, the notch 74 is aligned with the sector 54*h*, the installer notes that shims having an aggregate thickness substantially equal to 0.014 inch are required, which requirement may be satisfied by one shim of 0.010 inch thickness (color coded blue) plus one shim of 0.005 inch thickness (no color) as noted by the second indicia 66 (and third indicia 68) within the sector 54*h*.

After the correct shims 40 have been determined, the installer removes the chart 46 from the flash suppressor 24, and unthreads and removes the flash suppressor 24 from the barrel threaded muzzle end portion 38. The installer selects the determined shims 40 from the plurality of shims, which selection may be performed either before or after removal of the chart 46 and flash suppressor 24.

The installer may thereupon apply a high temperature adhesive (such as marketed under the trademark ROCK-SETT) to interfacing portions of the barrel muzzle and flash suppressor. The installer thereupon places the selected shims 40 (identified by the particular one of the sectors 54 aligned with the notch 74 when the flash suppressor 24 was threaded to the muzzle 38 hand tight) onto the barrel muzzle (preferably starting with the thinnest shim if more than one shim were identified) until the most rearward shim engages the barrel shoulder 42. The flash suppressor 24 is thereupon threaded onto the threaded barrel muzzle end portion 38, and the installer applies a torque to the flash suppressor 24 (such as by use of a conventional torquing tool) of between 20 and 30 foot-pounds such that the middle slot 34*c* is at the top dead center 12 o'clock position and the notch 74 is at the 6 o'clock position.

If desired, the chart 46 may be reinstalled onto the flash suppressor 24 before the torque application step, and during the torque application step the torque is applied to the flash suppressor 24 within the 20–30 foot-pound range until the flash suppressor's middle notch 34*c* is rotationally aligned with the vertical diameter on the chart 46 intercepting the sight alignment mark 52, or until the notch 74 is rotationally aligned with the vertical radius 62 (as may be further indicated by an arrow 76 on the chart 46 pointing to and rotationally aligned with the vertical radius 62).

In the event the middle slot 34*c* falls short of top dead center, the installer may apply 5 to 10 pounds of additional torque as necessary.

Prior to the adhesive applying step, the installer may desire to confirm that the identified shims 40 were correctly selected. After the chart 46 and flash suppressor 24 have been removed, the installer may place the selected shims 40 onto the barrel muzzle 38 until they engage the barrel shoulder 42. The installer then threads the flash suppressor 24 onto the barrel threaded muzzle end portion 38 hand tight, with the inserted shims 40 firmly engaged between the shoulders 42 and 44. With the correct shims in place, the notch 74 will be rotationally aligned with the sector 54*a*.

The flash suppressor 24 may be fixedly secured to the barrel 22, with the selected shims 40 interposed therebetween, by means other than the application of the adhesive. For example, instead of the adhesive applying step, the flash suppressor 24 may be welded to the barrel 22 after the selected shims 40 have been interposed and the torque applied.

Figure 9:
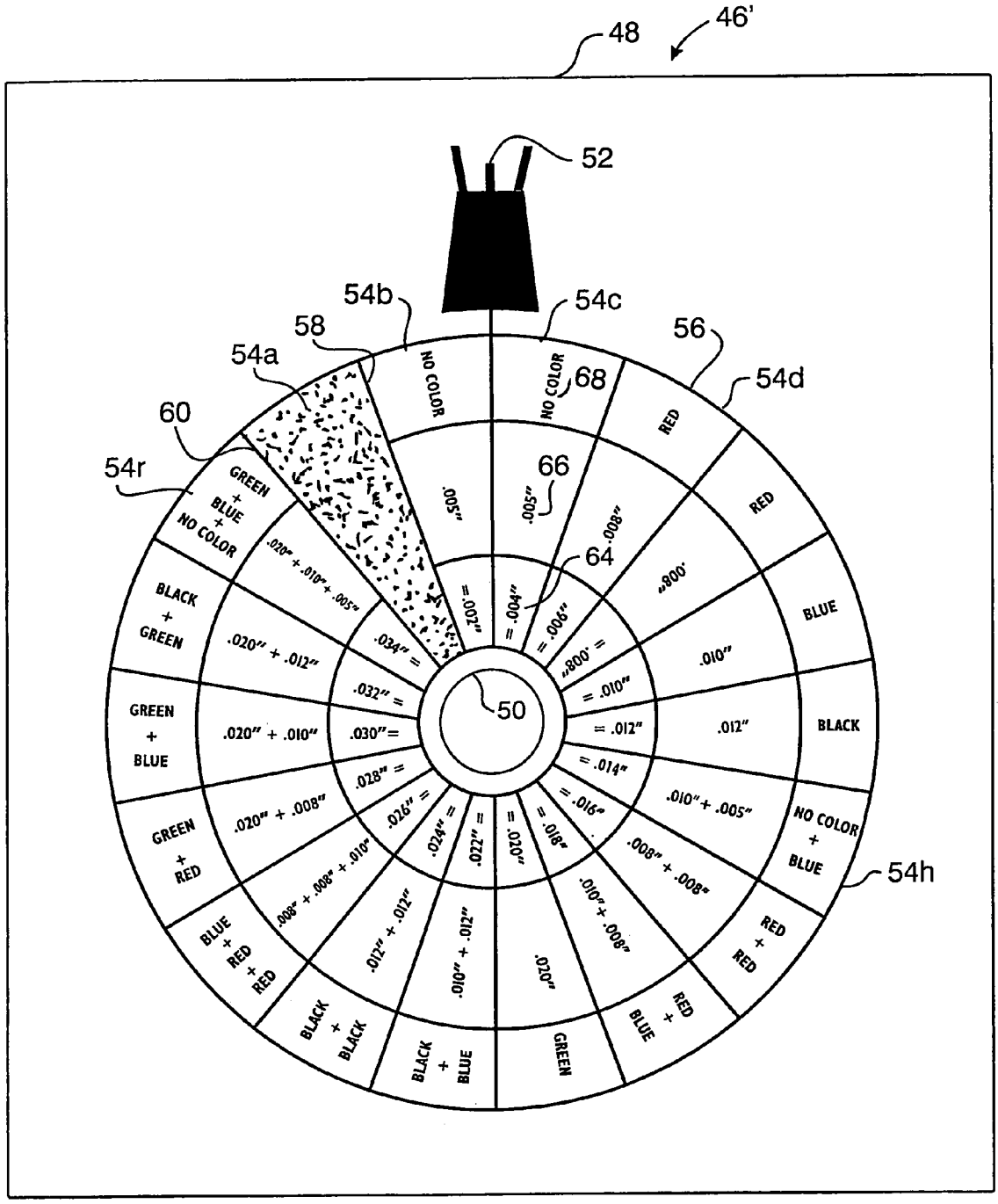
FIG. 9 is a front view of a second preferred embodiment of a chart according to the present invention for facilitating installation of the flash suppressor to the muzzle end portion of a firearm barrel in accordance with the method of the present invention.

In an alternative preferred embodiment of the chart 46' depicted in FIG. 9, the reference sector 54*a* is shown displaced from the sight alignment mark 52 (rather than from a chart location 180° from the sight alignment mark 52) by the rotational displacement representing application of the predetermined torque. Such position of the reference sector 54*a* in the chart 46' avoids providing a mark 70 on the flash suppressor wall 28 other than as provided by the middle slot 34*c*.

In practicing the method of the present invention using the alternative chart embodiment 46', the installer supports the firearm 20, threads the flash suppressor 24 hand tight onto the barrel threaded end portion 38, places the chart 46' onto the flash suppressor 24, and adjusts the rotational position of the chart 46' such that the sight alignment mark 52 is rotationally aligned with the firearm's sight 26, all in the same manner as described above when using the preferred chart embodiment 46.

At this point, however, the installer notes the rotational position of the center of the vent 34 (the middle slot 34*c*) of the flash suppressor 24 with respect to the sectors 54 on the chart 46'. The installer notes any one or more of the shim identifying indicia 64, 66, 68 within the particular sector 54 aligned with the middle slot 34*c*. If the middle slot 34*c* is aligned with reference sector 54*a*, the installer notes that no shim will be required. If, for example, middle slot 34*c* is aligned with the sector 54*h*, the installer notes that shims having an aggregate thickness substantially equal to 0.014 inch are required, which requirement may be satisfied by one shim of 0.010 inch thickness (color coded blue) plus one shim of 0.005 inch thickness (no color) as noted by the second indicia 66 (and third indicia 68) within the sector 54*h*.

After the correct shims 40 have been determined, the installer removes the chart 46' from the flash suppressor 24, and unthreads and removes the flash suppressor 24 from the barrel threaded muzzle end portion 38. The installer selects the determined shims 40 from the plurality of shims, which selection may be performed either before or after removal of the chart 46' and flash suppressor 24.

The installer may thereupon apply a high temperature adhesive (such as marketed under the trademark ROCK-SETT) to interfacing portions of the barrel muzzle and flash suppressor. The installer thereupon places the selected shims 40 (identified by the particular one of the sectors 54 aligned with the middle slot 34*c* when the flash suppressor 24 was threaded to the muzzle 38 hand tight) onto the barrel muzzle until the most rearward shim engages the barrel shoulder 42. The flash suppressor 24 is thereupon threaded onto the threaded barrel muzzle end portion 38, and the installer applies a torque to the flash suppressor 24 (such as by use of a conventional torquing tool) of between 20 and 30 foot-pounds such that the middle slot 34*c* is at the top dead center 12 o'clock position.

If desired, the chart 46' may be reinstalled onto the flash suppressor 24 before the torque application step, and during the torque application step the torque is applied to the flash suppressor 24 within the 20–30 foot-pound range until the flash suppressor's middle notch 34*c* is rotationally aligned with the vertical diameter on the chart 46' intercepting the sight alignment mark 52.

In the event the middle slot 34*c* falls short of top dead center upon application of 20 foot-pounds, the installer may apply additional torque as necessary up to a maximum torque of approximately 30 foot-pounds.

Prior to the adhesive applying step, the installer may desire to confirm that the identified shims 40 were correctly selected. After the chart 46' and flash suppressor 24 have been removed, the installer may place the selected shims 40 onto the barrel muzzle 38 until they engage the barrel shoulder 42. The installer then threads the flash suppressor 24 onto the barrel threaded muzzle end portion 38 hand tight, with the inserted shims 40 engaged between the shoulders 42 and 44. With the correct shims in place, the middle slot 34*c* will be rotationally aligned with the sector 54*a*.

As discussed earlier, the adhesive applying step may be omitted and other means, such as welding, may be used to fixedly secure the flash suppressor to the barrel with the selected shims interposed and the predetermined torque applied.

Thus, there have been disclosed preferred embodiments of a method and apparatus for installing a fixture such as a flash suppressor to the muzzle end portion of a firearm barrel, for greatly facilitating the selection of the appropriate shims by placing a chart or "timing wheel" to the fixture hand tightened to the firearm's muzzle without any shims placed thereon. The chart identifies the appropriate shims to be placed on the barrel's threaded muzzle end portion for positioning the center of the flash suppressor's vent substantially at top dead center with respect to the barrel when the predetermined torque is applied to the flash suppressor. Other embodiments of the present invention, and variations of the embodiments described herein, may be developed without departing from the essential characteristics thereof. Accordingly, the invention should be limited only by the scope of the claims listed below.

I claim:

1. A method for installing a fixture to a threaded muzzle end portion of a barrel of a firearm having a sight rearwardly of the threaded muzzle end portion, the barrel having a forwardly facing annular shoulder rearwardly of the threaded muzzle end portion, comprising the steps of:

providing a fixture including a generally cylindrical wall, an axial passageway having a threaded bore, a rearwardly facing annular shoulder rearwardly of said threaded bore, and a vent through said wall communicating with said passageway;

providing a plurality of annular shims of predetermined thicknesses;

providing a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with the center of said vent substantially at top dead center, one of said sectors corresponding to no shims required being displaced from a chart location at a predetermined rotational angle from said sight alignment mark by a rotational displacement representing application of the predetermined torque;

threading said fixture onto the threaded muzzle end portion of the barrel until said shoulder of said fixture is in contact engagement with the shoulder of the barrel;

placing said chart to said fixture such that said fixture axially extends through said aperture and with said sight alignment mark rotationally aligned with the sight of the firearm;

noting the identifying indicia in the sector to which a location on said, wall is rotationally aligned, said location on said wall being at said predetermined rotational angle from said center of said vent;

removing said chart from said fixture;

unthreading said fixture from said threaded muzzle end portion;

selecting shims from said plurality of shims, the selected shims determined by the noted identifying indicia;

placing said selected shims about said threaded muzzle end portion; and fixedly securing said fixture to the barrel when said fixture is threaded onto the threaded muzzle end portion with said selected shims interposed between said shoulder of said fixture and the shoulder of said barrel and with the predetermined torque applied to said fixture.

2. The method according to claim 1, wherein:

in the indicia noting step, said location of said wall is designated by a mark on said wall.

3. The method according to claim 2, wherein:

said mark comprises a notch at a front edge of said wall.

4. The method according to claim 1, wherein:

said predetermined rotational angle is substantially 180°.

5. The method according to claim 4, wherein:

in the indicia noting step, said location on said wall is designated by a mark on said wall.

6. The method according to claim 5, wherein:

said mark comprises a notch at a front edge of said wall.

7. A method for installing a fixture to a threaded muzzle end portion of a barrel of a firearm having a sight rearwardly of the threaded muzzle end portion, the barrel having a forwardly facing annular shoulder rearwardly of the threaded muzzle end portion, comprising the steps of:

providing a fixture including a generally cylindrical wall, an axial passageway having a threaded bore, a rearwardly facing annular shoulder rearwardly of said threaded bore, and a vent through said wall communicating with said passageway;

providing a plurality of annular shims of predetermined thicknesses;

providing a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with the center of said vent substantially at top dead center, one of said sectors corresponding to no shims required being displaced from said sight alignment mark by a rotational displacement representing application of the predetermined torque;

threading said fixture onto the threaded muzzle end portion of the barrel until said shoulder of said fixture is in contact engagement with the shoulder of the barrel;

placing said chart to said fixture such that said fixture axially extends through said aperture and with said sight alignment mark rotationally aligned with the sight of the firearm;

noting the identifying indicia in the sector to which said center of said vent is rotationally aligned;

removing said chart from said fixture;

unthreading said fixture from said threaded muzzle end portion;

selecting shims from said plurality of shims, the selected shims determined by the noted identifying indicia;

placing said selected shims about said threaded muzzle end portion; and fixedly securing said fixture to the barrel when said fixture is threaded onto the threaded muzzle end portion with said selected shims interposed between said shoulder of said fixture and the shoulder of said barrel and with said predetermined torque applied to said fixture.

8. In a method for installing a fixture to a threaded muzzle end portion of a barrel of a firearm having a sight rearwardly of the threaded muzzle end portion, the barrel having a forwardly facing annular shoulder rearwardly of the threaded muzzle end portion, the steps comprising:

providing a fixture including a generally cylindrical wall, an axial passageway having a threaded section, a rearwardly facing annular shoulder rearwardly of said threaded section, a vent through said wall communicating with said passageway; and a mark on said wall substantially 180° displaced from the center of said vent;

providing a plurality of annular shims of predetermined thicknesses;

providing a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with said vent substantially at top dead center, one of said sectors corresponding to no shims required being displaced from a chart location substantially 180° from said sight alignment mark by a rotational displacement representing application of the predetermined torque;

threading said fixture onto the threaded muzzle end portion of the barrel until said shoulder of said fixture contacts the shoulder of the barrel;

placing said chart to said fixture such that said fixture axially extends through said aperture and with said sight alignment mark rotationally aligned with the sight of the firearm;

noting the identifying indicia in the sector to which said mark on said wall is rotationally aligned;

removing said chart from said fixture;

unthreading said fixture from said threaded muzzle end portion;

selecting shims from said plurality of shims, the selected shims determined by the noted identifying indicia;

placing said selected shims about said threaded muzzle end portion; and threading said fixture onto the threaded muzzle end portion until said shoulder of said fixture and the shoulder of the barrel are engaged with said selected shims therebetween.

9. The method according to claim 8, including:

after the second-mentioned threading step, applying said predetermined torque to said fixture for tightening said fixture to said muzzle end portion.

10. The method according to claim 9, including:

after the unthreading step but before the torque applying step, applying an adhesive to the threaded muzzle end portion of the barrel.

11. The method according to claim 9, including:

after the torque applying step, fixedly securing the firearm barrel and the fixture for preventing rotation of the fixture on the muzzle end portion of the barrel.

12. The method according to claim 8, including:

after the second-mentioned threading step, replacing said chart to said fixture such that said fixture axially extends through said aperture and with said sight alignment mark rotationally aligned with the sight of the firearm; and confirming that said mark on said fixture is rotationally aligned with said one of said sectors.

13. The method according to claim 12, including:

after the confirming step, removing said chart from said fixture;

applying said predetermined torque to said fixture for tightening said fixture to said muzzle end portion to position said center of said vent substantially at top dead center.

14. The method according to claim 12, including:

after the confirming step, removing said chart from said fixture;

unthreading said fixture from said threaded muzzle end portion and removing said selected shims therefrom;

applying an adhesive to the threaded muzzle end portion of the barrel;

replacing said selected shims about said threaded muzzle end portion;

threading said fixture onto said threaded muzzle end portion until said shoulder of said fixture and the shoulder of the barrel are engaged with said selected shims therebetween; and applying said predetermined torque to said fixture for positioning said center of said vent substantially at top dead center.

15. The method according to claim 14, including:

during the torque applying step, adjusting the predetermined torque for assuring that said center of said vent is positioned substantially at top dead center.

16. The method according to claim 9, wherein:

during the torque applying step, adjusting the predetermined torque for assuring that said center of said vent is positioned substantially at top dead center.

17. The method according to claim 10, wherein:

during the torque applying step, adjusting the predetermined torque to assure that said mark on said wall is rotationally at the six o'clock position.

18. The method according to claim 8, wherein:

said mark on said wall comprises a notch at the front edge of said wall.

19. The method according to claim 8, wherein:

said fixture comprises a flash suppressor.

20. The method according to claim 19, including:

after the second-mentioned threading step, applying the predetermined torque to said flash suppressor for tightening said flash suppressor to said muzzle end portion.

21. The method according to claim 20, including:

after the unthreading step but before the torque applying step, applying an adhesive to the threaded muzzle end portion of the barrel.

22. The method according to claim 19, including:

after the torque applying step, fixedly securing the firearm barrel and said flash suppressor for preventing rotation of said flash suppressor on the muzzle end portion of the barrel.

23. The method according to claim 19, including:

after the second-mentioned threading step, replacing said chart to said flash suppressor such that said flash suppressor axially extends through said aperture and with said sight alignment mark rotationally aligned with the sight of the firearm; and confirming that said mark on said flash suppressor is rotationally aligned with said one of said sectors.

24. The method according to claim 20, including:

during the torque applying step, adjusting the predetermined torque for assuring that said center of said vent is positioned substantially at top dead center.

25. The method according to claim 21, including:

during the torque application step, adjusting the predetermined torque to assure that said mark on said wall is positioned substantially at the six o'clock position.

26. The method according to claim 19, wherein:

said mark on said wall comprises a notch at the front edge of said wall.

27. The method according to claim 26, including:

after the second-mentioned threading step, applying said predetermined torque to said flash suppressor for tightening said flash suppressor to said muzzle end portion.

28. The method according to claim 27, including:

after the unthreading step but before the torque applying step, applying an adhesive to the threaded muzzle end portion of the barrel.

29. The method according to claim 27, including:

after the torque applying step, fixedly securing the firearm barrel and the flash suppressor for preventing rotation of the flash suppressor with respect to the muzzle end portion of the barrel.

30. The method according to claim 26, including:

after the second-mentioned threading step, replacing said chart to said flash suppressor such that said flash suppressor axially extends through said aperture and with said sight alignment mark rotationally aligned with the sight of the firearm; and confirming that said notch is rotationally aligned with said one of said sectors.

31. The method according to claim 27, wherein:

during the torque applying step, adjusting the predetermined torque for assuring that said center of said vent is positioned substantially at top dead center.

32. The method according to claim 28, wherein:

during the torque applying step, adjusting the predetermined torque to assure that said notch is positioned substantially at the six o'clock position.

33. In a method for installing a fixture to a threaded muzzle end portion of a barrel of a firearm having a sight rearwardly of the threaded muzzle end portion, the barrel having a forwardly facing annular shoulder rearwardly of the threaded muzzle end portion, the steps comprising:

providing a fixture including a generally cylindrical wall, an axial passageway having a threaded bore, a rearwardly facing annular shoulder rearwardly of said threaded bore, and a vent through said wall communicating with said passageway;

providing a plurality of annular shims of predetermined thicknesses;

providing a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with said vent substantially at top dead center, one of said sectors corresponding to no shims required being displaced from said sight alignment mark by a rotational displacement representing application of the predetermined torque;

threading said fixture onto the threaded muzzle end portion of the barrel until said shoulder of said fixture contacts the shoulder of the barrel;

placing said chart to said fixture such that said fixture axially extends through said aperture and with said sight alignment mark rotationally aligned with the sight of the firearm;

noting the identifying indicia in the sector to which said mark on said wall is rotationally aligned;

removing said chart from said fixture;

unthreading said fixture from said threaded muzzle end portion;

selecting shims from said plurality of shims, the selected shims determined by the noted identifying indicia;

placing said selected shims about said threaded muzzle end portion; and threading said fixture onto the threaded muzzle end portion until said shoulder of said fixture and the shoulder of the barrel are engaged with said selected shims therebetween.

34. The method according to claim 33, including:

after the second-mentioned threading step, applying said predetermined torque to said fixture for tightening said fixture to said muzzle end portion.

35. The method according to claim 34, including:

after the unthreading step but before the torque applying step, applying an adhesive to the threaded muzzle end portion of the barrel.

36. The method according to claim 34, including:

after the torque applying step, fixedly securing the firearm barrel and the fixture for preventing rotation of the fixture on the muzzle end portion of the barrel.

37. The method according to claim 33, including:

after the second-mentioned threading step, replacing said chart to said fixture such that said fixture axially extends through said aperture and with said sight alignment mark rotationally aligned with the sight of the firearm; and confirming that said vent is rotationally aligned with said one of said sectors.

38. The method according to claim 37, including:

after the confirming step, removing said chart from said fixture;

applying said predetermined torque to said fixture for tightening said fixture to said muzzle end portion to position said center of said vent substantially at top dead center.

39. The method according to claim 37, including:

after the confirming step, removing said chart from said fixture;

unthreading said fixture from said threaded muzzle end portion and removing said selected shims therefrom;

applying an adhesive to the threaded muzzle end portion of the barrel;

replacing said selected shims about said threaded muzzle end portion;

threading said fixture onto said threaded muzzle end portion until said shoulder of said fixture and the shoulder of the barrel are engaged with said selected shims therebetween; and applying said predetermined torque to said fixture for positioning said center of said vent substantially at top dead center.

40. The method according to claim 39, including:

during the torque applying step, adjusting the predetermined torque for assuring that said center of said vent is position substantially at top dead center.

41. The method according to claim 33, wherein:

during the torque applying step, adjusting the predetermined torque for assuring that said center of said vent is positioned substantially at top dead center.

42. The method according to claim 33, wherein:

said fixture comprises a flash suppressor.

43. A chart for facilitating installation of a fixture to a threaded muzzle end portion of a barrel of a firearm having a sight rearwardly of the threaded muzzle end portion, the fixture including an axial passageway having a threaded bore, a rearwardly facing annular shoulder rearwardly of the threaded section, and a vent communicating with the passageway, the barrel of the firearm including a forwardly facing annular shoulder rearwardly of the threaded muzzle end portion, the chart comprising:

a substrate having a central aperture for axially receiving the fixture;

a sight alignment mark on said substrate vertically above the center of said aperture; and printed sectors about said aperture including indicia identifying shims for being interposed between the shoulder of the fixture and the shoulder of the barrel when the fixture is threaded onto the threaded muzzle end portion and a predetermined torque is applied to the fixture for rotationally positioning the fixture with the center of the vent substantially at top dead center, one of said sectors corresponding to no shims required being displaced from a chart location at a predetermined rotational angle from said sight alignment mark by a rotational displacement representing application of the predetermined torque.

44. The chart according to claim 43, wherein:

said predetermined rotational angle is substantially 180°.

45. The chart according to claim 43, wherein:

said indicia respectively included in said sectors identify the shims by calculated aggregate thicknesses.

46. The chart according to claim 45, wherein:

the calculations of aggregate shim thicknesses correspond to unthreading translation of the fixture on the threaded muzzle end portion of the barrel of the firearm.

47. The chart according to claim 43, wherein:

said indicia respectively included in said sectors identify the shims by thicknesses of specific ones of the provided shims.

48. The chart according to claim 43, wherein:

said indicia respectively included in said sectors identify the shims by color code associated with specific ones of the provided shims.

49. The chart according to claim 43, wherein:

said indicia respectively included in said sectors identify the shims by one or more indicia selected from the group consisting of calculated aggregate thicknesses, thicknesses of specific ones of the provided shims, and color code associated with specific ones of the provided shims.

50. A chart for facilitating installation of a fixture to a threaded muzzle end portion of a barrel of a firearm having a sight rearwardly of the threaded muzzle end portion, the fixture including an axial passageway having a threaded bore, a rearwardly facing annular shoulder rearwardly of the threaded bore, and a vent communicating with the passageway, the barrel of the firearm including a forwardly facing annular shoulder rearwardly of the threaded muzzle end portion, the chart comprising:

a substrate having a central aperture for axially receiving the fixture;

a sight alignment mark on said substrate vertically above the center of said aperture; and printed sectors about said aperture including indicia identifying shims for being interposed between the shoulder of the fixture and the shoulder of the barrel when the fixture is threaded onto the threaded muzzle end portion and a predetermined torque is applied to the fixture for rotationally positioning the fixture with the center of the vent substantially at top dead center, one of said sectors corresponding to no shims required being displaced from said sight alignment mark by a rotational displacement representing application of the predetermined torque.

51. The chart according to claim 50, wherein:

said indicia respectively included in said sectors identify the required shims by calculated aggregate thicknesses.

52. The chart according to claim 51, wherein:

the calculations of aggregate shim thicknesses correspond to unthreading translation of the flash suppressor on the threaded muzzle end portion of the barrel of the firearm.

53. The chart according to claim 50, wherein:

said indicia respectively included in said sectors identify the shims by thicknesses of specific ones of the provided shims.

54. The chart according to claim 50, wherein:

said indicia respectively included in said sectors identify the shims by color code associated with specific ones of the provided shims.

55. The chart according to claim 50, wherein:

said indicia respectively included in said sectors identify the shims by one or more indicia selected from the group consisting of calculated aggregate thicknesses, thicknesses of specific ones of the provided shims, and color code associated with specific ones of the provided shims.

56. A chart for facilitating installation of a flash suppressor to a threaded muzzle end portion of a barrel of a firearm having a sight rearwardly of the threaded muzzle end portion, the flash suppressor including an axial passageway having a threaded bore, a rearwardly facing annular shoulder rearwardly of the threaded bore, and a vent communicating with the passageway, and a mark on the flash suppressor substantially 180° displaced from the center of the vent, the barrel of the firearm including a forwardly facing annular shoulder rearwardly of the threaded muzzle end portion, the chart comprising:

a substrate having a central aperture for axially receiving the flash suppressor;

a sight alignment mark on said substrate vertically above the center of said aperture; and printed sectors about said aperture including indicia identifying shims for being interposed between the shoulder of the flash suppressor and the shoulder of the barrel when the flash suppressor is threaded onto the threaded muzzle end portion and a predetermined torque is applied to the flash suppressor for rotationally positioning the flash suppressor with the center of the vent substantially at top dead center, one of said sectors corresponding to no shims required being displaced from a chart location 180° from said sight alignment mark by a rotational displacement representing application of the predetermined torque.

57. The chart according to claim 56, wherein:

said indicia respectively included in said sectors identify the shims by calculated aggregate thicknesses.

58. The chart according to claim 57, wherein:

the calculations of aggregate shim thicknesses correspond to unthreading translation of the fixture on the threaded muzzle end portion of the barrel of the firearm.

59. The chart according to claim 56, wherein:

said indicia respectively included in said sectors identify the shims by thicknesses of specific ones of the provided shims.

60. The chart according to claim 56, wherein:

said indicia respectively included in said sectors identify the shims by color code associated with specific ones of the provided shims.

61. The chart according to claim 56, wherein:

said indicia respectively included in said sectors identify the shims by one or more indicia selected from the group comprising calculated aggregate thicknesses, thicknesses of specific ones of the provided shims, and color code associated with specific ones of the provided shims.

62. Apparatus for installing a fixture to a threaded muzzle end portion of a barrel of a firearm having a sight rearwardly of the threaded muzzle end portion, the barrel having a forwardly facing annular shoulder rearwardly of the threaded muzzle end portion, the apparatus comprising in combination:

a fixture including a generally cylindrical wall, an axial passageway having a threaded section, a rearwardly facing annular shoulder rearwardly of said threaded section, and a vent through said wall communicating with said passageway;

a plurality of annular shims of predetermined thicknesses;

a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with the center of said vent substantially at top dead center, one of said sectors corresponding to no shims required being displaced from a chart location at a predetermined rotational angle from said sight alignment mark by a rotational displacement representing application of the predetermined torque.

63. The apparatus according to claim 62, wherein:

said indicia respectively included in said sectors of said chart identify the shims by one or more of indicia selected from the group consisting of calculated aggregate thicknesses, thicknesses of specific ones of the provided shims, and color code associated with specific ones of the provided shims.

64. The apparatus according to claim 62, wherein:

said fixture includes a mark on said wall rotationally displaced from the center of said vent by said predetermined rotational angle.

65. The apparatus according to claim 64, wherein:

said predetermined rotational angle is substantially 180°.

66. The apparatus according to claim 64, wherein:

said mark comprises a notch at a front edge of said wall.

67. The apparatus according to claim 66, wherein:

said predetermined rotational angle is substantially 180°.

68. Apparatus for installing a fixture to a threaded muzzle end portion of a barrel of a firearm having a sight rearwardly of the threaded muzzle end portion, the barrel having a forwardly facing annular shoulder rearwardly of the threaded muzzle end portion, the apparatus comprising in combination:

a fixture including a generally cylindrical wall, an axial passageway having a threaded section, a rearwardly facing annular shoulder rearwardly of said threaded section, and a vent through said wall communicating with said passageway;

a plurality of annular shims of predetermined thicknesses; and a chart having an aperture for axially receiving said fixture, said chart including a sight alignment mark vertically above the center of said aperture, said chart including sectors about said aperture including indicia identifying shims for being interposed between said shoulders when said fixture is threaded onto the threaded muzzle end portion and a predetermined torque is applied thereto for rotationally positioning said fixture with the center of said vent substantially at top dead center, one of said sectors corresponding to no shims required being displaced from said sight alignment mark by a rotational displacement representing application of the predetermined torque.

69. The apparatus according to claim 68, wherein:

said indicia respectively included in said sectors identify the shims by one or more indicia selected from the group consisting of calculated aggregate thicknesses, thicknesses of specific ones of the provided shims, and color code associated with specific ones of the provided shims.

* * * * *